United States Patent [19]

Tellie

[11] B 4,002,101

[45] Jan. 11, 1977

[54] FIREARMS

[76] Inventor: Paul E. Tellie, 20 rue Bergson, 42000 Saint-Etienne, France

[22] Filed: May 17, 1974

[21] Appl. No.: 470,853

[44] Published under the second Trial Voluntary Protest Program on March 23, 1976 as document No. B 470,853.

[30] Foreign Application Priority Data

May 29, 1973 France ..... 73.19393

[52] U.S. Cl. ..... 89/142; 42/70 E; 89/148

[51] Int. Cl.[2] ..... F41C 17/02; F41D 11/02

[58] Field of Search ..... 89/142, 148; 42/70 E

[56] References Cited

UNITED STATES PATENTS

| | | | |
|---|---|---|---|
| 1,441,807 | 1/1923 | Horan | 89/142 |
| 1,561,756 | 11/1925 | Tucker | 89/142 |
| 2,195,693 | 4/1940 | Clifton | 42/70 E |
| 2,371,012 | 3/1945 | Woodhull | 89/142 |
| 2,863,359 | 12/1958 | Kunz | 89/142 |
| 2,881,547 | 4/1959 | Butler | 42/70 E |
| 3,045,555 | 7/1962 | Stoner | 89/142 |
| 3,713,242 | 1/1973 | Seifried | 89/142 |

FOREIGN PATENTS OR APPLICATIONS

| | | | |
|---|---|---|---|
| 441,352 | 3/1927 | Germany | 89/142 |

*Primary Examiner*—Charles T. Jordan
*Attorney, Agent, or Firm*—Stevens, Davis, Miller & Mosher

[57] ABSTRACT

A firearm capable of shooting in bursts, or to fire shot by shot, or to have a safety position in which no firing is possible. The firearm includes a firing selector in the vicinity of the trigger. The firing selector is arranged so that its outer part can occupy a central position symmetrical with respect to the vertical plane passing through the axis of the firearm, a right-hand eccentric position located to the right of the plane, and a left-hand position located to the left of the plane. The central position corresponds to the "safety" position of the firing selector and the two off-center positions correspond to the "burst" and "shot-by-shot" positions. In a first embodiment, the firing selector slides in a direction perpendicular to the vertical plane passing through the axis of the firearm, and is formed by a slide which has a stepwise inner part and an outer part formed by its two ends which protrude on the right-hand and left-hand sides of the firearm. In another embodiment, the firing selector is of the turning type and is formed by a turning part with steps or cams constituting its inner part in order to control the rotation thereof. The pivoting part, which constitutes the outer part, is arranged in front of the trigger of the firearm and is mounted pivotally around an axis which is substantially perpendicular to the axis of the firearm.

7 Claims, 11 Drawing Figures

FIG. 1
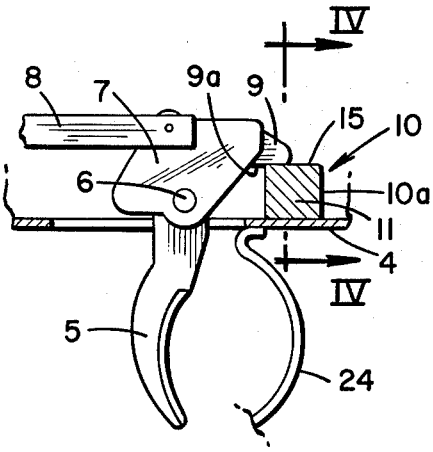
FIG. 4
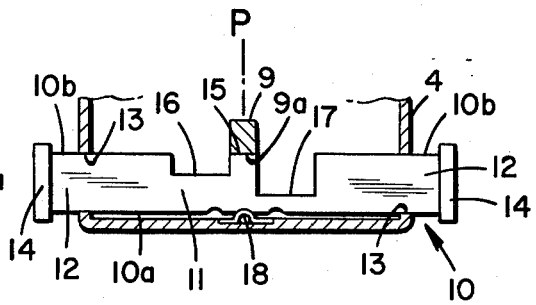
FIG. 2
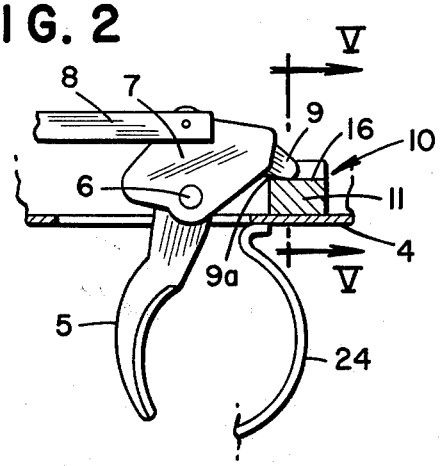
FIG. 5
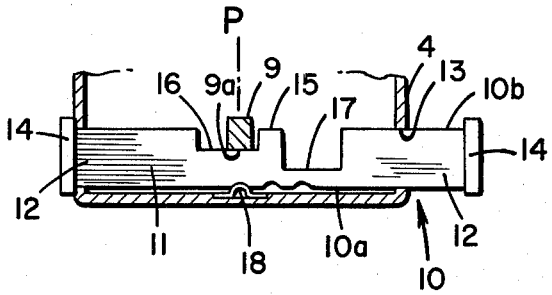
FIG. 6
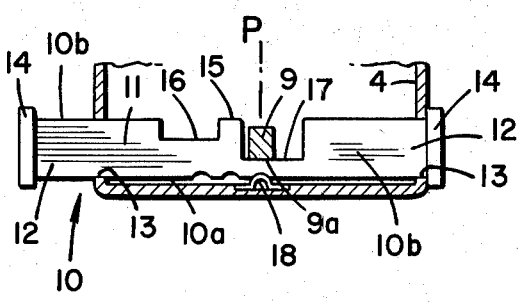
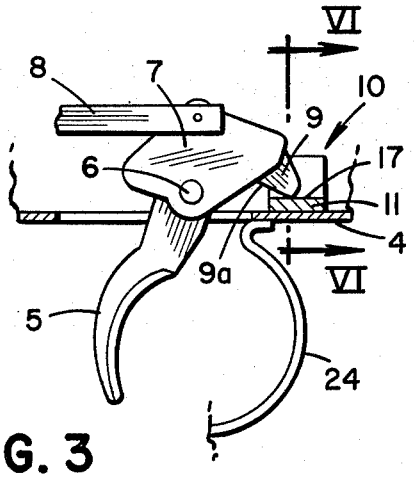
FIG. 3

FIG. 10
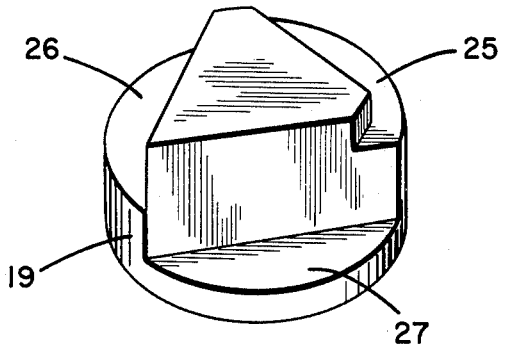
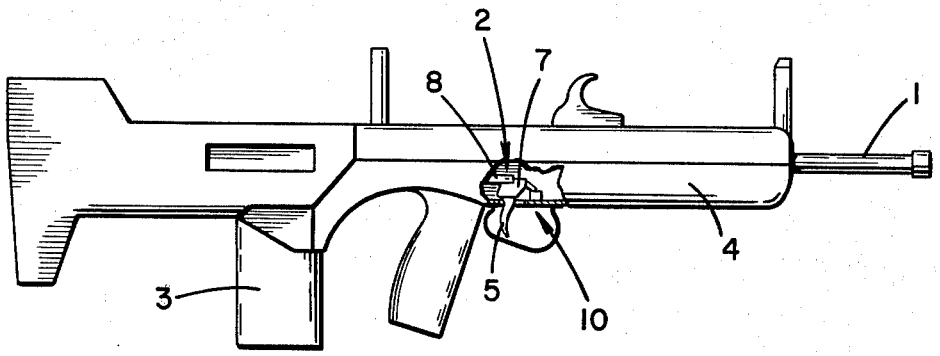
FIG. 11

FIREARMS

The present invention relates to the type of firearms known as "automatic firearms," that is to say, firearms adapted, in particular, with respect to their mechanism and their feed, to be able to effect shooting in bursts, or to fire shot by shot, and to have a safety position in which no firing is possible.

For this purpose it is known to provide such weapons with a firing selector which consists of an internal part cooperating with the mechanism of the weapon and an external part intended to be actuated by the marksman.

Such a firing selector may therefore occupy any of three positions, namely:

- a "burst" position in which the inner part cooperates with the mechanism of the firearm to permit continuousburst firing as long as the marksman presses on the trigger, or limited firing by means of a burst limiter,
- a "shot-by-shot" position in which the inner part cooperates with the mechanism of the weapon to permit shot-by-shot firing when the marksman presses the trigger, and
- a "safety" position in which the inner part cooperates with the mechanism of the weapon to prevent firing, even when the marksman presses the trigger.

It will then be seen that a knowledge by the marksman of the position of the firing selector, which position he notes by the position of the outer part of the said firing selector, is of considerable importance. As a matter of fact, when the marksman grasps his weapon in order to use it as rapidly as possible, any loss of time on his part in order to determine the position of the firing selector may be fatal for him.

In order to reduce this loss of time, it has already been proposed to arrange the firing selector, at least with respect to its outer part, in a position close to the trigger.

However, the purpose of this arrangement was to facilitate the operating of the outer part of the firing selector, which operation could be effected by one of the fingers of the marksman, generally his thumb or index finger.

However, it was necessary for the marksman visually to note the position of the firing selector, which, in view of the generally small dimensions of the outer part of the firing selector, required relatively careful observation. Furthermore, the use in nighttime of the firearm raised problems.

The object of the present invention is a weapon whose firing selector is adapted, particularly with regard to its outer part, to permit the marksman on the one hand to note its position, not only visually, but furthermore by feel of its outer part, and on the other hand to be able when necessary to change said position very rapidly.

The invention applies more particularly to small-caliber firearms (rifles, carbines, machine pistols, automatic rifles), since it is these weapons which are most subject to different manipulations involving the shifting of the firing selector by the marksman. As a matter of fact, due to their mobility and lightness, the marksman may hold his weapon with two hands in front of him, hold it at arm's length if a grip is provided for this purpose, maintain the firearm at his shoulder, or else sling fit the firearm across his shoulder.

It is when the marksman must seize his firearm in order to use it that he must know as soon as possible the position of the firing selector in order possibly to change it.

The firearm, in accordance with the invention, comprises a firing selector arranged in the vicinity of the trigger of the firearm and it is characterized by the fact that this firing selector is so arranged that its outer part, at least, can occupy, as compared with the vertical plane passing through the axis of the firearm, a central position which is symmetrical with respect to said plane, a right-hand eccentric position located to the right of said plane, and a left-hand eccentric position located to the left of said plane. The central position of the outer part corresponds to the "safety" position of the firing selector, and the two off-center positions correspond to the other two positions of the firing selector, namely the "burst" position and the "shot-by-shot" position.

In accordance with a first embodiment of the invention, the firing selector is of the type which slides in a direction perpendicular to the vertical plane passing through the axis of the firearm, and it is formed by a slide which has a stepwise inner part and an outer part formed by its two ends which protrude on the right-hand and left-hand sides of the firearm.

In accordance with another embodiment of the invention, the firing selector is of the turning type and it is formed by a turning part with steps or cams constituting its inner part and by a pivoting part connected to the said turning part in order to control the rotation thereof. The pivoting part, which constitutes the outer part, is arranged in front of the trigger of the firearm and is mounted pivotally around an axis which is substantially perpendicular to the axis of the firearm.

Aside from the arrangements referred to above, the invention consists of certain other arrangements which are used preferably simultaneously and which will be discussed more specifically below.

In any event, the invention will be fully understood from the additional description which follows, as well as from the accompanying drawings, the said description and drawings concerning preferred embodiments of the invention and, of course, being in no way limitative.

FIG. 1 of these drawings is a partial, broken view of a firearm developed in accordance with a first embodiment of the invention, the firing selector being shown in its "safety" position.

FIG. 2 is a view of the firearm of FIG. 1, but with the firing selector shown in its "burst" position.

FIG. 3 is a view of the firearm of FIG. 1, but with the firing selector shown in its "shot-by-shot" position.

FIG. 4 is a cross section along the line IV—IV of FIG. 1.

FIG. 5 is a cross section along the line V—V of FIG. 2.

FIG. 6 is a cross section along the line VI—VI of FIG. 3.

FIG. 10 is a perspective view of the inner part of the firing selector of the firearm shown in FIGS. 7, 8 and 9.

Figure 7:
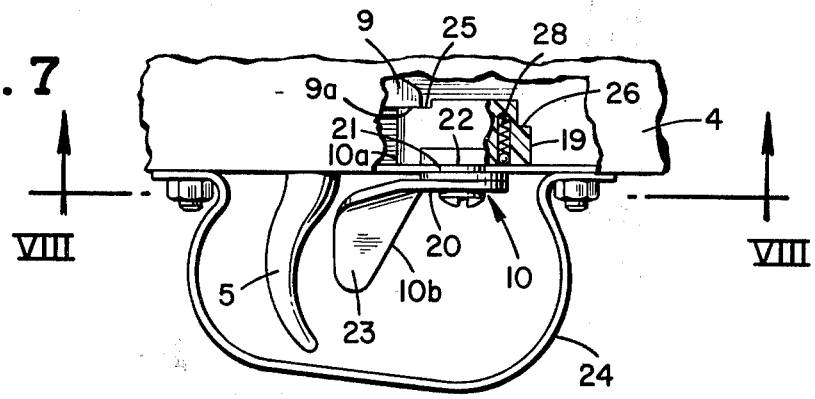
FIG. 7 is a partial cross section through a firearm developed in accordance with another embodiment of the invention, the firing selector being shown in its "safety" position.

FIG. 11, finally, is a general view of the firearm in accordance with the invention.

In FIG. 11 there is shown a firearm which comprises a barrel 1, a mechanism designated 2 and a feed 3 capable of feeding the firearm. The entire firearm is supported by a structure or forestock 4.

The mechanism 2 comprises in particular, as shown in FIGS. 1, 2, 3 and 7, a trigger 5 which is pivotally mounted around a pin 6 and which is rigidly connected with a rocker 7 which is attached to a connecting rod 8 by a pivot, the said rod 8 being in its turn connected to the other component parts of the mechanism 2. This rocker 7 is rigidly connected with an extension 9 whose lower face 9*a* forms a resting surface.

The firearm thus constituted comprises a firing selector, designated by the reference number 10, and formed of an inner part 10*a* cooperating with the mechanism 2 of the firearm, and by an outer part 10*b* intended to be actuated by the marksman. This firing selector 10 is arranged in the vicinity of the trigger 5.

Figure 9:
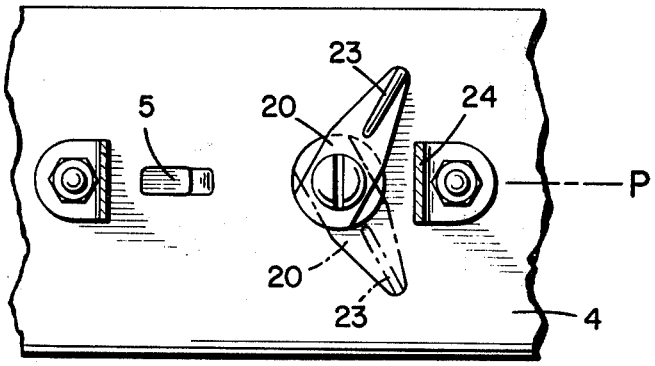
FIG. 9 is a cross section similar to that of FIG. 8, but with the firing selector shown in its "burst" position (solid line) and in its "shot-by-shot" position (dashed line).
Figure 8:
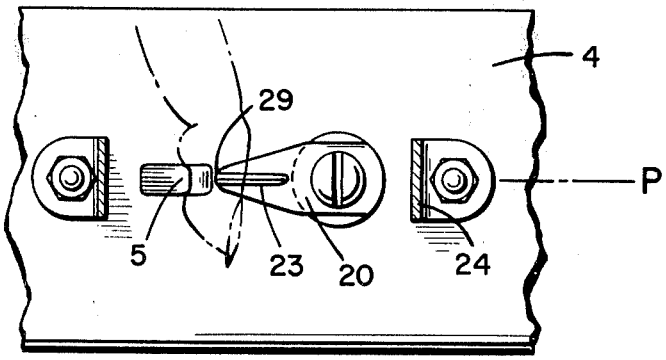
FIG. 8 is a cross section along the line VIII—VIII of FIG. 7.

In accordance with the invention, this firing selector 10 is so arranged that its outer part 10*b* can occupy, with respect to the vertical plane P passing through the axis of the firearm (axis of its barrel 1):

- a central position, which is symmetrical with respect to the said plane P (FIGS. 1 and 4 and FIGS. 7 and 8),
- a right-hand off-center position, located to the right with respect to the said plane P (FIGS. 2 and 5 and FIG. 9 in solid line), and
- a left-hand off-center position, located to the left with respect to the said plane (FIGS. 3 and 6 and FIG. 9 in dashed line).

The central position of the outer part 10*b* (FIG. 4 and FIGS. 7 and 8) corresponds to the "safety" position of the firing selector 10, and the two other positions (FIGS. 5 and 6 and FIG. 9) correspond to the other two positions of the firing selector 10, namely the "burst" position and the "shot-by-shot" position.

In accordance with the embodiment of the invention illustrated in FIGS. 1 to 6, the firing selector 10 is of the type sliding in a direction perpendicular to the vertical plane P passing through the axis of the firearm.

This firing selector 10 is formed of a slide 11 which has an inner part 10*a* with steps and an outer part 10*b* formed by its two ends 12 which protrude on the right-hand and left-hand sides of the firearm.

For this purpose the firearm is provided in its forestock 4, in front of the trigger guard 24, with two lateral orifices 13 serving as a guide for the slide 11. The two ends 12 of the slide 11 are provided with thrust collars 14 of dimensions which are slightly greater than those of the lateral orifices 13. The thrust collars 14 limit the transverse movement of the slide 11 and serve for its actuation by the marksman.

The inner part 10*a* of the slide 11 which forms the firing selector 10 has three steps 15, 16 and 17, and it is so arranged that the said steps can cooperate, by impact, with the lower face 9*a* forming a resting surface of the extension 9 of the rocker 7.

These three steps 15, 16 and 17 are of different heights with respect to the axis of the slide 11.

The highest step 15 is arranged in the central region and is surrounded on the one side by a medium step 16 and on the other side by a low step 17.

Depending on the position of the firing selector 10 thus constituted, the trigger 5 can therefore effect:

- a very short, or even practically zero, stroke if the high step 15 is below the lower face 9*a* of the extension 9 of the rocker 7,
- a medium stroke if the middle step 16 is below the lower face 9*a* of the extension 9 of the rocker 7, or
- a large stroke if the low step 17 is below the lower face 9*a* of the extension 9 of the rocker 7.

By a suitable arrangement of the mechanism 2 of the firearm, there are therefore obtained the three positions of the firing selector 10, namely:

- the "safety" position, practically zero stroke of the trigger 5 limited by the high step 15,
- the "burst" position, medium stroke of the trigger 5 limited by the middle step 16, and
- the "shot-by-shot" position, large stroke of the trigger 5 limited by the low step 17.

Locking means 18, for instance of spring type, may be provided to lock the slide 11 in each of the three positions of the firing selector 10.

It will then be seen that a firing selector 10 developed in the manner which has just been stated permits the marksman to determine extremely rapidly the position which is occupied. As a matter of fact, a mere glance of the eye makes it possible, whatever the position of the firearm (held in front by the marksman, held at arm's length, on the shoulder, or slung over the shoulder), to note the position of the firing selector. Furthermore, the passage of the hand along the firearm, both over its right side and over its left side, makes it possible to note by feel a slight protrusion of the outer part 10*b* of the firing selector 10 ("safety" position), alignment, or a substantial protrusion on one side or the other ("burst" position or "shot-by-shot" position, depending on the side).

Once the marksman knows the position of the firing selector 10, he can, if necessary, change it very rapidly.

In accordance with the embodiment of the invention shown in FIGS. 7 to 10, the firing selector 10 is of the turning type and is formed by a turning part 19 with steps constituting its inner part 10*a*, and by a pivoting part 20 to control the rotation thereof. The pivoting part 20, which constitutes the outer part 10*b*, being arranged in front of the trigger 5 of the firearm and mounted pivotally around a pin which is substantially perpendicular to the axis of the firearm.

For this purpose, the firearm is provided in its forestock 4 with a central bore 21 which permits the pivoting of a pin 22 bearing the pivoting part 20 whose end forms a downward extending tab 23.

The arrangement of this pivoting part 20 with respect to the trigger 5 is such that its axis 22 is located between the trigger 5 and the front portion of the trigger guard 24. This trigger guard 24 limits the angular movement of the pivoting part 20.

The inner part 10*a* formed by the turning part 19 has three steps 25, 26 and 27 and it is so arranged that the said steps may cooperate by impact with the lower face 9*a* forming the resting surface of the extension 9 of the rocker 7 (FIG. 10).

These three steps 25, 26, 27 are of different heights with respect to the base of the turning part 19.

The highest step 25 extends over a sector of about 120° and it is surrounded on the one side by a medium step 26 which also extends over a sector of about 120° and on the other side by a low step 27 which also extends over a sector of about 120°.

Depending on the position of the firing selector 10, which is thus formed, the trigger 5 can therefore carry out:

- a very small or even practically zero stroke if the high step 25 is under the lower face 9*a* of the extension 9 of the rocker 7,
- a medium stroke if the medium step 26 is below the lower face 9*a* of the extension 9 of the rocker 7, or
- a large stroke if the low step 27 is below the lower face 9*a* of the extension 9 of the rocker 7.

By a suitable arrangement of the mechanism 2 of the firearm, one therefore obtains the three positions of the firing selector 10, namely:

- the "safety" position, practically zero stroke of the trigger 5 limited by the high step 25,
- the "burst" position, medium stroke of the trigger 5 limited by the medium step 26, and
- the "shot-by-shot" position, large stroke of the trigger 5 limited by the low step 27.

Interlock means 28, for instance of ball type, can be provided to lock the turning part 19 in each of the three positions of the firing selector 10.

The pivoting part 20 can advantageously be arranged, particularly with reference to the size of the tab 23, in such a manner as to define, together with the trigger 5, a space 29 which is much less than the thickness of the index finger when the firing selector 10 is in its "safety" position.

The turning part 19 can be connected directly to the pivoting part 20 and arranged coaxially with the axis 22 of the pivoting part 20, as shown in the embodiment described above. However, the turning part 19 could be connected to the pivoting part 20 by a connecting-rod or gear system.

It should be pointed out that the turning part 19 could be provided with cams of different heights rather than with steps.

It will then be evident that a firing selector 10 developed in the manner which has just been described makes it possible for the marksman to determine the position occupied extremely rapidly. As a matter of fact, a mere glance of the eye makes it possible to note, whatever the position of the firearm (held in front by the marksman, held at arm's length, at the shoulder or slung over the shoulder), the position of the firing selector. Furthermore, the placing of the index finger into the trigger guard 24 makes it possible to note by feel whether the outer part 10*b*, tab 23, of the firing selector 10 is just in front of the trigger 5 ("safety" position) or whether it is moved over to one ("shot-by-shot" position) side or the other side ("burst" position), depending on the side.

It should also be pointed out that in the "safety" position, the outer part 10*b* constitutes an obstacle which prevents accidental actuation of the trigger 5.

Once the marksman knows the position of the firing selector 10, he can, if desired, change it very rapidly.

Finally, whatever the embodiment employed, one has a firearm whose firing selector has the advantage of being accessible to the marksman who can therefore rapidly, by visual observation or feel, determine the position occupied by the said firing selector and, if desired, modify it.

As goes without saying, and as is evident furthermore from the foregoing, the invention is by no means limited to those of its embodiments or methods of application which have been more particularly contemplated; rather, it covers all possible variants.

I claim:

1. An automatic firearm comprising:

a trigger, and a firing selector positioned adjacent said trigger, said firing selector comprising an inner part cooperating with a mechanism of the firearm and an outer part actuable by a marksman, said outer part being movable, relative to the vertical plane passing through the longitudinal axis of the firearm, into a central position symmetrical relative to said plane, a right-hand off center position to the right of said plane relative to the front end of the firearm, and a left-hand off-center position to the left of said plane relative to the front end of the firearm, and the central position corresponds to a "safety" position of the firing selector and the two off-center positions correspond to a "burst" position and a "shot-by-shot" position of the firing selector, said firing selector being turnable, said inner part comprising a turning part, said outer part comprising a pivoting part connected to said turning part to control its rotation, and said pivoting part being positioned in front of the trigger and mounted pivotally around a pin which is substantially perpendicular to the longitudinal axis of the firearm.

2. An automatic firearm as claimed in claim 1, wherein: the turning part has steps thereon.

3. An automatic firearm as claimed in claim 2, wherein: the pivoting part comprises an end forming a tab which extends downward.

4. An automatic firearm as claimed in claim 3, further comprising: a trigger guard, the pin of the pivoting part being positioned between the trigger and the front portion of the trigger guard, and the trigger guard limiting the angular displacement of the pivoting part.

5. An automatic firearm as claimed in claim 4, wherein: the tab of the pivoting part is positioned to define, together with the trigger, a space which is much less than the thickness of an index finger when the firing selector occupies the "safety" position.

6. An automatic firearm as claimed in claim 1, wherein: the turning part is directly connected to the pivoting part.

7. An automatic firearm as claimed in claim 2, wherein: the turning part has a base and three steps of different heights with respect to said base.

* * * * *